United States Patent [19]

Koblo et al.

[11] 4,313,666

[45] Feb. 2, 1982

[54] APPARATUS FOR DEVELOPING LIGHT-SENSITIVE RECORDING MATERIALS

[75] Inventors: Jochen Koblo, Wiesbaden-Auringen; Götz von dem Bussche, Schwalbach, both of Fed. Rep. of Germany

[73] Assignee: Hoechst Aktiengesellschaft, Fed. Rep. of Germany

[21] Appl. No.: 163,583

[22] Filed: Jun. 27, 1980

[30] Foreign Application Priority Data

Jun. 28, 1979 [DE] Fed. Rep. of Germany ..... 2926084

[51] Int. Cl.[3] ..... G03D 7/00

[52] U.S. Cl. ..... 354/299; 354/300

[58] Field of Search ..... 354/299, 300, 317; 355/27, 100

[56] References Cited

U.S. PATENT DOCUMENTS

| | | | |
|---|---|---|---|
| 3,149,550 | 9/1964 | Lohse et al. | 354/299 |
| 3,323,436 | 6/1967 | Hafer et al. | 354/300 |
| 3,364,833 | 1/1968 | Mulvany | 354/300 |
| 3,446,135 | 5/1969 | Dorman | 354/300 |
| 3,748,995 | 7/1973 | Schroter et al. | 354/300 |
| 4,141,640 | 2/1979 | Roberts | 354/300 |
| 4,172,652 | 10/1979 | Stein | 354/300 |

FOREIGN PATENT DOCUMENTS

| | | | |
|---|---|---|---|
| 1522867 | 3/1971 | Fed. Rep. of Germany | 354/300 |
| 2145079 | 3/1973 | Fed. Rep. of Germany | 354/300 |

*Primary Examiner*—L. T. Hix
*Assistant Examiner*—Alan Mathews
*Attorney, Agent, or Firm*—James E. Bryan

[57] ABSTRACT

This invention relates to an apparatus for developing light-sensitive recording materials with a vaporous developing medium in a developing chamber, comprising housing means having a vapor space therein, aperture means in said vapor space, external and internal pressure means adapted to close said aperture means, said external pressure means having a height of lift X and being equipped with heating means, said internal pressure means being adapted to close said aperture means in a gas-tight manner and having a height of lift Y which is greater than X, and vaporizer means connected to said vapor space.

7 Claims, 2 Drawing Figures

APPARATUS FOR DEVELOPING LIGHT-SENSITIVE RECORDING MATERIALS

Figure 1:
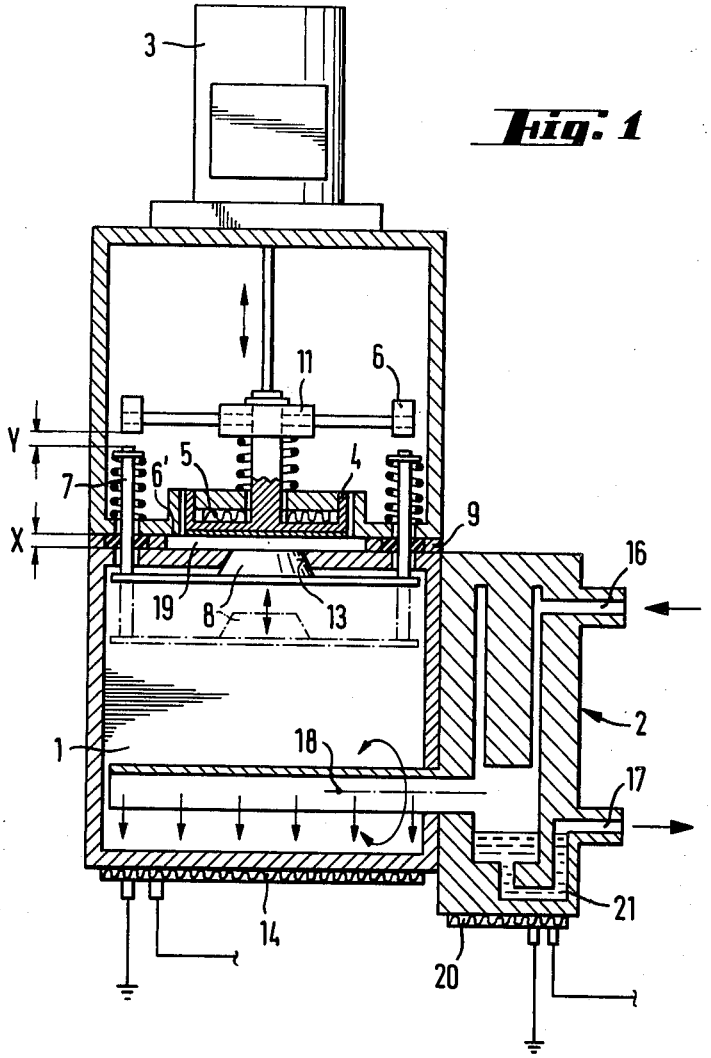

The present invention relates to an apparatus for developing light-sensitive recording materials with a vaporous developing medium in a developing chamber. The apparatus is especially intended for developing microfilms having diazo layers, in such a way that the carton of the film card does not come into contact with the developing medium.

Previously proposed developing apparatuses which operate without pressure or almost pressureless comprise housings into which film cards are introduced between a cover plate and a table plate. The introduced cards lie above an opening in the developing chamber. In order to prevent the developing gas or vapor from escaping into the atmosphere through the card feed slot, air is drawn in through this slot. The drawn in air is then led into an absorber or into a discharge device via a vent outlet.

German Pat. No. 1,522,867, describes a developing apparatus for light-sensitive layers, wherein the developing chamber is in communication with a second chamber into which the air contained in the developing chamber can pass when the chamber is closed and developing gas is introduced therein. The air must be expelled from the developing chamber to ensure a uniform development. The film is developed with ammonia under pressure. After development, the developing gas is led into an absorber. The residual gas remaining in the developing chamber, however, can escape into the atmosphere, when the developing chamber is opened to remove the film card. Such an apparatus has proved to be difficult to handle. It is more complicated to operate, especially because of the required pressure-tightness and does not function sufficiently free of exhaust air. In addition, the entire developing chamber must be evacuated after development and must be refilled prior to any new developing procedure.

In German Pat. No. 2,145,079, an apparatus for developing light-sensitive materials, particulary diazofilms in film window cards, is disclosed, which comprises a housing which constitutes the developing chamber in combination with one stationary and two movable plates. The stationary plate is provided with an opening of the same size as the film window and through this opening the developing medium can act upon the film to be developed. The first movable plate seals the opening against the atmosphere, and the second movable plate which is arranged inside the developing chamber opposite to the stationary plate provides for sealing prior to and after development. Such an apparatus is complicated, does not allow a speedy operation, and yields satisfactory results only if it works under pressure. After depletion by a few percent, the developing medium, for example, aqueous ammonia vapor, must be replaced by fresh, more highly concentrated developing medium.

It is, therefore, an object of the present invention to provide an apparatus for developing light-sensitive materials, which is uncomplicated, has a relatively low consumption of developing medium, operates without pressure and with a brief developing time, and does not emit any exhaust air.

This object is achieved by an apparatus for developing light-sensitive recording materials with a vaporous developing medium in a developing chamber, comprising a housing which contains a vapor space and is capable of being closed by an external and an internal pressure member, and further comprising an appertaining vaporizer. The apparatus has the features that the external pressure member which has a height of lift X is equipped with a heating means, that the conically shaped internal pressure member provides for gas-tight sealing of an opening and has a longer height of lift Y, and that the vaporizer can be heated by a heater which is arranged at the vapor space. The distance Y exceeds the distance X by about 0.5 to 2 mm, preferably by about 0.5 to 1 mm.

The invention has the advantage that, with a relatively small technical expenditure, the apparatus can operate without pressure and without exhaust air, i.e. ecologically acceptably, and after a short heating-up time. Being equipped with an attenuated DC magnet, the apparatus runs very quietly. In addition, the positional independence of the developing chamber with respect to the appertaining vaporizer allows any desired space-saving arrangement of the developing chamber which is then linked with the vaporizer by means of a highly heat-conducting connection. If necessary, the vaporizer may have an additional heating device.

The apparatus of the invention is particularly suitable for developing diazofilms in film cards, but it also may be used for developing light-sensitive paper or the like. About 15 to 20 copies per minute can be produced in the apparatus.

As the developing medium, amines or, preferably, ammonia may be used. When an aqueous ammonia solution is employed for development, the vapor produced in the vaporizer is, according to the invention, substantially heated when it enters into the vapor space and, for this purpose, the vapor space is equipped with heating devices. Preferably, plate heaters are used which are fastened to the housing wall. With the aid of thermostats and control units the temperatures are adjusted to and maintained within a range from 85° to 95° C. According to the invention, the external pressure member which covers the recording material is also heated.

It is not necessary to flush the developing chamber with air, as in the case of the apparatuses known from the prior art. Due to the temperatures chosen, the developing chamber does not emit any vapor or condensate into the atmosphere; this is additionally prevented by the internal pressure member which conically seals the vapor space during the removal of the developed recording material.

The two pressure members are preferably moved with the aid of a magnet which is manually actuated by means of a switch. It is, furthermore, possible to equip the apparatus of the invention with a switching element, for example, a microswitch, which is actuated by the recording material when it is introduced into the apparatus and which energizes or deenergizes the magnet via a timing relay and thus controls the displacement of the pressure members. The apparatus also may operate as a continuous developing apparatus, wherein the exposed material is fed in on one side and leaves the apparatus on the other side. This is particularly advantageous if the developing apparatus is part of an equipment wherein the recording material is also exposed to light. In that case, the exposed recording material is automatically conveyed from the exposure section to the development section and is then issued.

Figure 2:
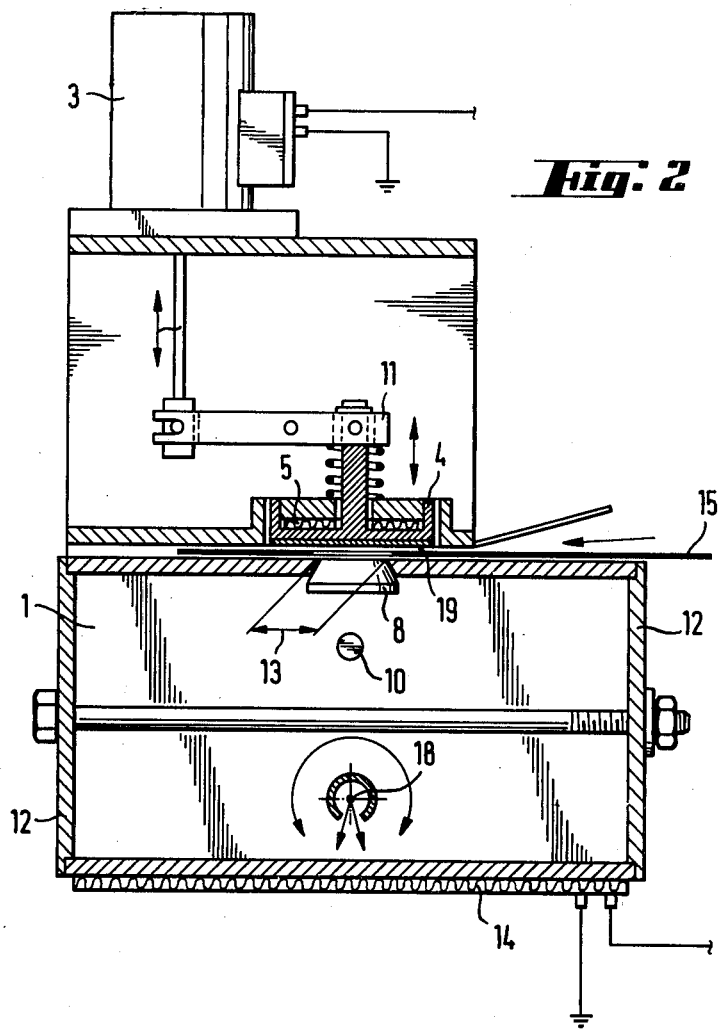

The invention will be further illustrated by reference to the accompanying drawings, in which:

FIG. 1 depicts in a cross-sectional view the arrangement of the developing chamber of the invention, together with the vaporizer, and FIG. 2 shows the developing chamber in a longitudinal section.

The apparatus of the invention has a feed slot 19 for the recording material 15 (FIG. 2). A vapor space 1 is provided with an opening 13 (FIG. 2) which is conically sealed by an internal pressure member 8. Thus, the vapor space 1 is sealed towards the outside prior to and after development. An external pressure member 4, together with the recording material 15 to be developed, seals against the atmosphere. The vapor space 1 is closed by inspection covers 12 (FIG. 2).

An appertaining vaporizer 2 which is mounted outside of the vapor space 1 about a pivot point 18 and which has an inlet 16 and an outlet 17 and, if appropriate, a heating device 20, is heated via the vapor space 1 by means of a heater 14 arranged in the admission zone of the developing medium, in such a way that the temperature in the vapor space 1 is always higher than the temperature in the vaporizer 2. It is possible to provide several heaters 14, preferably, however, one plate heater 14 is used. Heating in this manner has the effect that no condensate can deposit in the vapor space 1 or on the recording material 15. A heating means 5 which is mounted on the pressure member 4 serves the same purpose.

The temperature of the heating means 5 is adjusted to such a level that it is equal to or, preferably, higher than the temperature prevailing in the vapor space 1. Advantageously, the temperature of the heating means 5 is about 2° C. higher than the temperature in the vapor space 1. The developing medium contained in the vapor space 1, in turn, has a higher temperature than the developing medium in the vaporizer. Preferably, the temperature in the vapor space is from 4° to 6° C. higher than the temperature in the vaporizer, and it may, for example, be controlled by a thermocouple 10. In this way, a temperature gradient is produced in the indicated direction, which prevents any condensation on the pressure member 4 or in the vapor space 1 and ensures a dry development.

The heights of lift X and Y between the top of the housing 6' and the final position of the pressure member 4 and between a driving element 6 and a closure guide means 7 having a gasket 9 are chosen in such a manner that when the distance X equals zero, the distance Y is still greater than zero and reaches its terminal point only after a further displacement of the pressure member 8. Movement is effected by a magnet 3 via a pressing level 11. As a result, the recording material 15 to be developed is already pressed against the opening and the pressure member 4 closes tightly in final position, before the pressure member 8 is retracted from the opening in the direction of the vapor space to start the developing procedure.

After development, the internal pressure member 8 is first moved back into the opening 13. The seal in the opening 13 is conically shaped and it forces the developing medium present in this area, for example, a mixture of ammonia and water vapor, completely back into the vapor space 1 during closing. The pressure member 8 may be equipped with a conventional elastomer gasket.

Only after the pressure member 8 has again adopted its sealing position, the pressure member 4 begins to release the developed recording material 15 and when it has reached its original distance, the recording material 15 can be removed.

In combination with the externally arranged vaporizer 2 which is designed as an open system with an odor seal 21, the apparatus can operate without pressure and exhaust air, and the ammonia/water mixture can be utilized until its ammonia content is about 3% or less. The heating device 20 disposed at the vaporizer 2 may be used to raise the temperature of the residual water in the siphon which serves as the odor seal 21. As a result, the ammonia still contained in the residual water is expelled, which accounts for the above-mentioned low ammonia content. In this way, the developing medium supplied can be more effectively utilized than in the apparatuses hitherto known. The ammonia saturated with water vapor enters into the vapor space 1 from the vaporizer 2, in the direction of the heaters 14. This has proved to be very advantageous, because any dirt or lime particles which may be present can be thus separated and prevented from coming into contact with the delicate recording material.

Other than depicted in FIGS. 1 and 2, the vaporizer 2 also may be arranged in spaced relationship with respect to the developing chamber and may be linked with the developing chamber by means of a highly heat-conducting connection. This is advantageous if, for example for reasons of space, the position of the individual apparatus must be adapted to a continuously operating equipment. In that case, it also has proved to be appropriate to heat the vaporizer 2, for example, with the aid of the heating device 20.

It will be obvious to those skilled in the art that many modifications may be made within the scope of the present invention without departing from the spirit thereof, and the invention includes all such modifications.

What is claimed is:

1. An apparatus for developing light-sensitive recording material with a vaporous developing medium in a developing chamber, comprising housing means having a vapor space therein, aperture means in said vapor space, external and internal pressure means adapted to close said aperture means, said external pressure means having a height of lift X between the top of the housing and a final position of the external pressure means, and being equipped with heating means, said internal pressure means being adapted to close said aperture means in a gas-tight manner and having a height of lift Y, between a driving element for said internal pressure means and a closure guide means for said internal pressure means, which is greater than X, and vaporizer means connected to said vapor space.

2. An apparatus according to claim 1 in which said internal pressure means is conically shaped.

3. An apparatus according to claim 1 including heater means for heating said vaporizer means.

4. An apparatus according to claim 1 in which distance Y exceeds distance X by about 0.5 to 2 mm.

5. An apparatus according to claim 1 or 4 including heater means for heating said external pressure means to a temperature at least 2° C. higher than the prevailing temperature in the vapor space.

6. An apparatus according to claims 1 or 4 including heater means for heating said vapor space to a temperature 4° to 6° C. higher than the temperature in the vaporizer means.

7. An apparatus according to claim 1 including means pivotally mounting said vaporizer means on said housing means, whereby said vaporizer means is positionally independent of said developing chamber.

* * * * *